US011034473B2

(12) United States Patent
Shi et al.

(10) Patent No.: US 11,034,473 B2
(45) Date of Patent: Jun. 15, 2021

(54) MACHINE FOR MANUFACTURING A COFFEE CAPSULE

(71) Applicant: Jiangsu Kunge Intelligent Technology Co., Ltd., Yancheng (CN)

(72) Inventors: Junda Shi, Yuyao (CN); Zhongyu Shi, Yuyao (CN); Shukuo Liu, Yuyao (CN); Xiaolei Chen, Yuyao (CN)

(73) Assignee: Jiangsu Kunge Intelligent Technology Co., Ltd., Yancheng (CN)

( * ) Notice: Subject to any disclaimer, the term of this patent is extended or adjusted under 35 U.S.C. 154(b) by 128 days.

(21) Appl. No.: 16/509,089

(22) Filed: Jul. 11, 2019

(65) Prior Publication Data

US 2020/0324927 A1 Oct. 15, 2020

(30) Foreign Application Priority Data

Apr. 15, 2019 (CN) ..... 201910297585.0

(51) Int. Cl.
*B65B 29/02* (2006.01)

(52) U.S. Cl.
CPC ..... *B65B 29/022* (2017.08)

(58) Field of Classification Search
CPC ..... B65B 29/022; B65B 29/025; A47J 31/407
USPC ..... 53/52
See application file for complete search history.

(56) References Cited

U.S. PATENT DOCUMENTS 10,486,896 B2 * 11/2019 Lamb ..... B65D 85/8043
10,722,066 B2 * 7/2020 Rivera ..... B65B 29/022
2007/0144356 A1 * 6/2007 Rivera ..... A47J 31/44 99/295
2016/0144987 A1 * 5/2016 Scrivani ..... B65B 61/005 53/487
2017/0043943 A1 * 2/2017 Lamb ..... B65B 29/022
2017/0144785 A1 * 5/2017 Bartoli ..... B26F 1/44
2017/0283101 A1 * 10/2017 Gorbatenko ..... B65B 43/50
2018/0110356 A1 * 4/2018 Rivera ..... A47J 31/08
2018/0116444 A1 * 5/2018 Rivera ..... A47J 31/407
2018/0279822 A1 * 10/2018 Bertash ..... B65B 29/022
2019/0126530 A1 * 5/2019 Smeulders ..... B29C 51/30
2019/0135466 A1 * 5/2019 Gorbatenko ..... B65B 43/50
2019/0225357 A1 * 7/2019 Belbecir ..... B65B 29/022
2020/0087011 A1 * 3/2020 Lui ..... A47J 42/26
2020/0305634 A1 * 10/2020 Rivera ..... A47J 31/404

* cited by examiner

*Primary Examiner* — Dariush Seif
(74) *Attorney, Agent, or Firm* — Avant Law Group, LLC

(57) ABSTRACT

Some embodiments of the disclosure provide a machine for manufacturing a coffee capsule. The machine includes an upper portion structure, a capsule holder, and a lower portion structure sequentially arranged from top to bottom. The capsule holder is used for bearing a coffee capsule. The upper portion structure includes a box body, a control unit, a heating unit, a preheating switch, a temperature probe, a power line, and a position sensing structure. The temperature probe is used for sensing the temperature of the heating unit. The heating unit is arranged at the lower side of the box body and is in separable contact with the coffee capsule in the capsule holder. The position sensing structure can sense and identify contact and separation of the heating unit and the coffee capsule. The position sensing structure can further transmit a signal to the control unit.

11 Claims, 15 Drawing Sheets

MACHINE FOR MANUFACTURING A COFFEE CAPSULE

CROSS REFERENCE TO RELATED APPLICATIONS

This application claims priority to Chinese application number 20191029758-5.0 filed on Apr. 15, 2019, the disclosure of which is incorporated by reference herein in its entirety.

FIELD OF THE DISCLOSURE

The disclosure relates generally to the field of coffee capsule manufacturing technologies. More specifically, the disclosure relates to a machine for manufacturing a coffee capsule.

BACKGROUND

Coffee facilitates the metabolic function, activates digestive organs and has the functions of resisting oxidation, protecting the heart, strengthening the bones, muscles, waist and knees, appetizing, burning fat, removing food retention, disinhibiting the orifices, dispelling dampness, activating blood circulation to dissipate stasis, extinguishing wind to arrest convulsion and the like. Researches show that it is sufficient to refresh without harm to the health if people drinks a cup of coffee containing the caffeine of 100-200 mg every day.

A coffee capsule is simple to manufacture, convenient to use and disposable, avoiding the cleaning trouble. Currently, there is increasing demand on coffee. The existing machine for manufacturing a coffee capsule generally has a large size and high cost, and is mainly for commercial use.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

In some embodiments, a machine for manufacturing a coffee capsule includes an upper portion structure, a capsule holder, and a lower portion structure sequentially arranged from top to bottom. The upper surface of the upper portion structure includes a recess for accommodating the capsule holder. The capsule holder is used for bearing a coffee capsule. The upper portion structure includes a box body, a control unit, a heating unit, a preheating switch, a temperature probe, a power line, and a position sensing structure. The heating unit, the preheating switch, the temperature probe, the power line, and the position sensing structure are respectively electrically connected with the control unit. The temperature probe is used for sensing the temperature of the heating unit, the control unit is arranged in the box body, the preheating switch is arranged at the outer side of the box body, the heating unit is arranged at the lower side of the box body and is in separable contact with the coffee capsule in the capsule holder, the position sensing structure can sense and identify contact and separation of the heating unit and the coffee capsule and transmits a signal to the control unit, and the power line is used for connecting to an external power supply.

Optionally, the box body includes a plurality of guide bars. The lower portion structure includes guide holes matching with the guide bars. A guide spring sleeves the outer side of the guide bar, or the guide spring is filled in the guide bar. The upper end of the guide spring abuts against the box body, the lower end of the guide spring abuts against the lower portion structure, the position sensing structure is a position switch, and the position switch is electrically connected to the control unit.

Optionally, the box body includes a top cover and a base, which are detachably fixedly connected.

Optionally, the heating unit is locked on the base by fasteners.

In other embodiments, the machine for manufacturing a coffee capsule further includes a motor and a sliding block structure located on the lower side of the motor. The motor is fixed in the box body and is electrically connected to the control unit. A control button is arranged on the outer side of the box body and can control operation of the motor. An output shaft of the motor is inserted into the sliding block structure downwards and is in threaded connection with the sliding block structure. The sliding block structure is connected to an axial hole of the box body such that the sliding block structure does not rotate when moving up and down. The heating unit is fixed to the sliding block structure. A gap is formed in a side face of the lower portion structure, the capsule holder can be put in and taken out through the gap, and a holder cover is detachably fixed to the gap.

In further embodiments, the box body includes an overlay surface, a second PCB switch board, an upper cover, a housing, and a lower support sequentially arranged from top to bottom. A motor bracket is arranged in the box body, the overlay surface is adhered on the upper surface of the upper cover, the second PCB switch board is fixed to the upper cover, a through hole for accommodating the second PCB switch board is formed in the upper cover, the second PCB switch board is electrically connected to the control unit, the upper cover is fixed to an opening of the upper portion of the housing, the motor is fixed to the motor bracket, the sliding block structure includes a nut block and a heating unit bracket, the nut block is in threaded connection with the output shaft of the motor, the nut block is detachably fixed to the heating unit bracket, through holes allowing penetration of guide shafts are formed in the heating unit bracket, the upper end and the lower end of the guide shaft are respectively inserted into limiting blind holes of the motor bracket and the lower support, and the motor bracket and the housing are respectively detachably and fixedly connected to the lower support.

Optionally, the heating unit is locked on the heating unit bracket by fasteners.

Optionally, the position sensing structure is fixed to the heating unit bracket and includes a second micro switch and a third micro switch. The second micro switch is used for sensing a relative position of the heating unit bracket and the lower support. The third micro switch is used for sensing a relative position of the heating unit bracket and the motor bracket. The second micro switch and the third micro switch are electrically connected with the control unit.

Optionally, the position sensing structure is a blocked-rotor detection unit, the blocked-rotor detection unit is used for detecting whether the motor conducts rotor blockage, and the blocked-rotor detection unit is electrically connected to the control unit.

Optionally, the heating unit includes a thermal conduction plate, a heating sheet, a mica plate, and a thermal insulation seal ring sequentially arranged from bottom to top.

DETAILED DESCRIPTION

Figure 1:
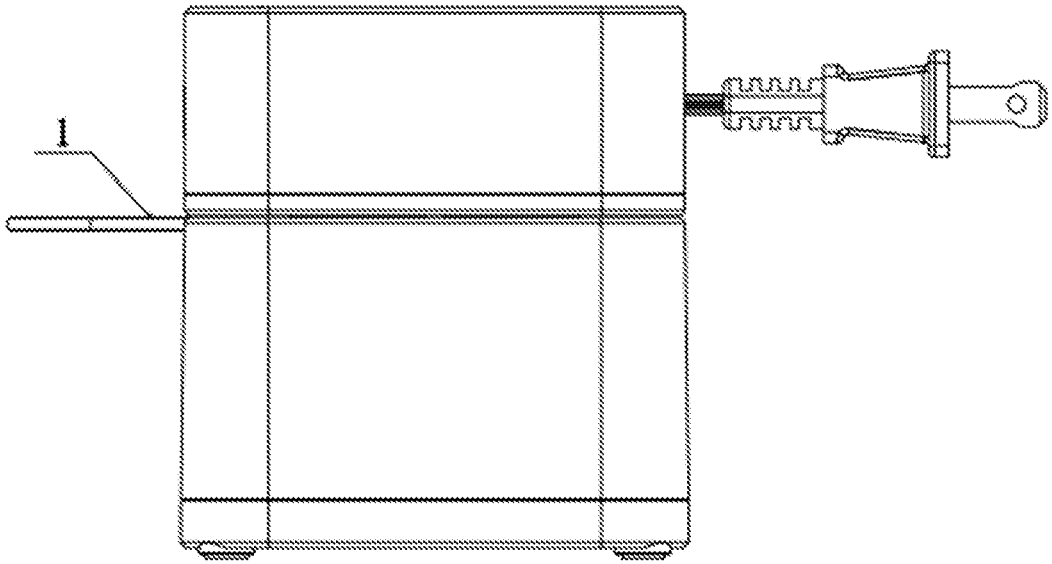
FIG. 1 is a right view of a machine for manufacturing a coffee capsule in a hot pressing state according to Embodiment 2 of the disclosure.
Figure 2:
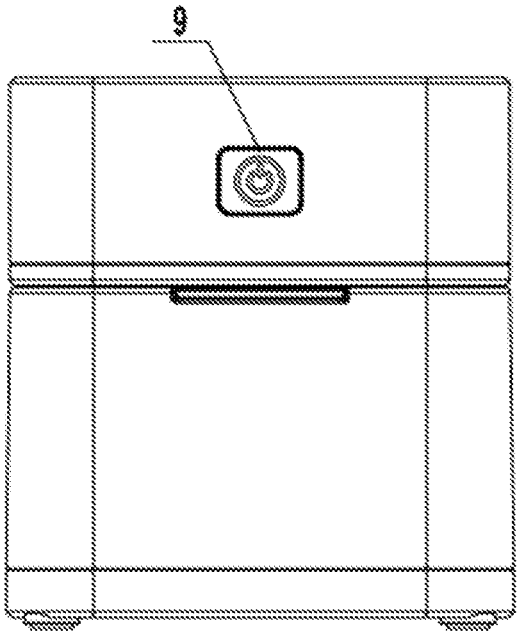
FIG. 2 is a front view of the machine for manufacturing a coffee capsule in the hot pressing state according to Embodiment 2 of the disclosure.
Figure 3:
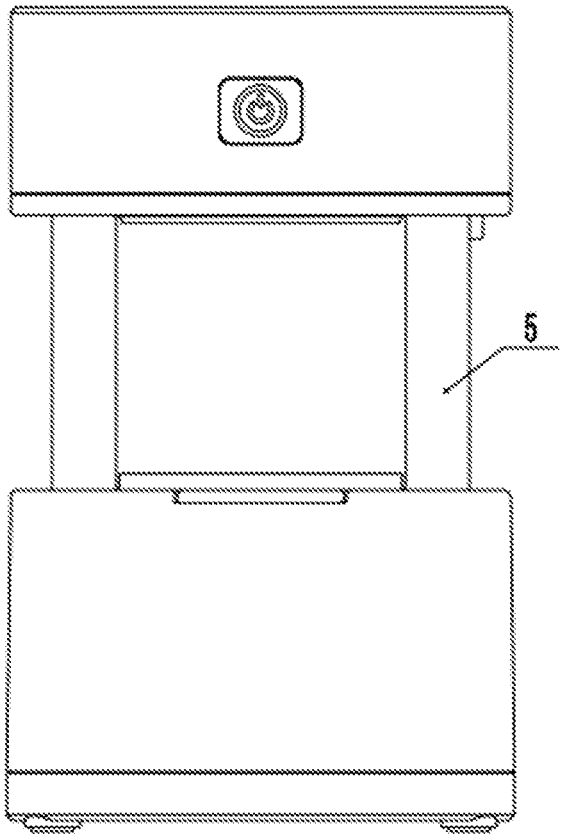
FIG. 3 is a schematic diagram of the machine for manufacturing a coffee capsule, which is not in the hot pressing state, in FIG. 2.
Figure 4:
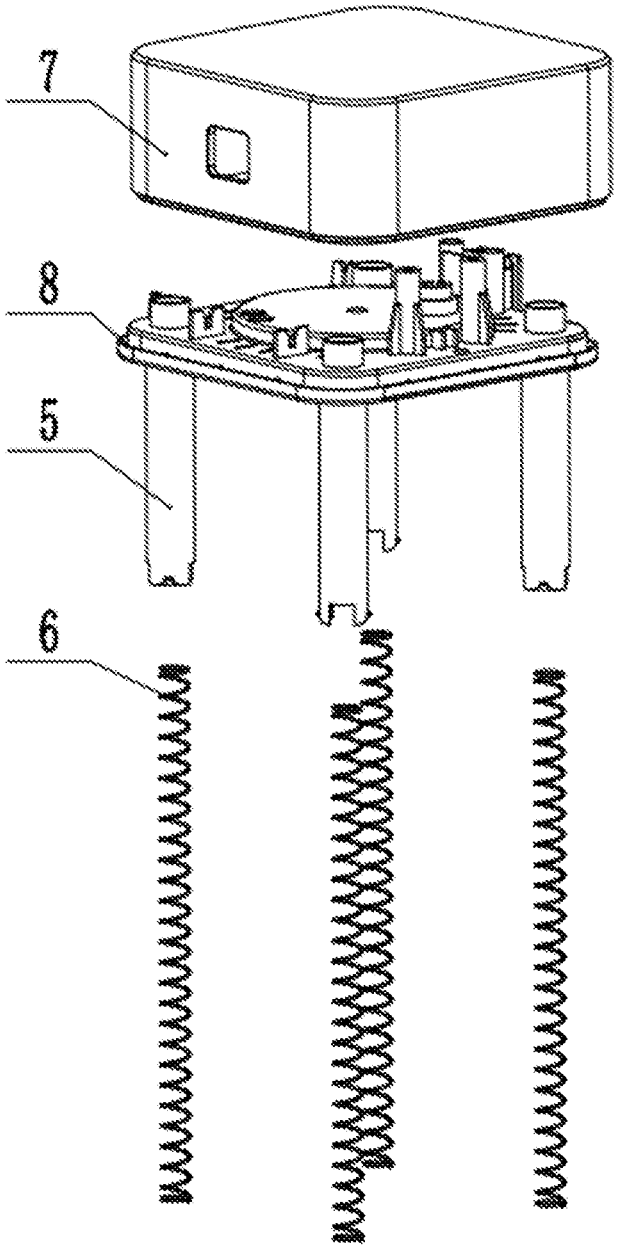
FIG. 4 is a schematic structural diagram of a box body according to Embodiment 2 of the disclosure.
Figure 5:
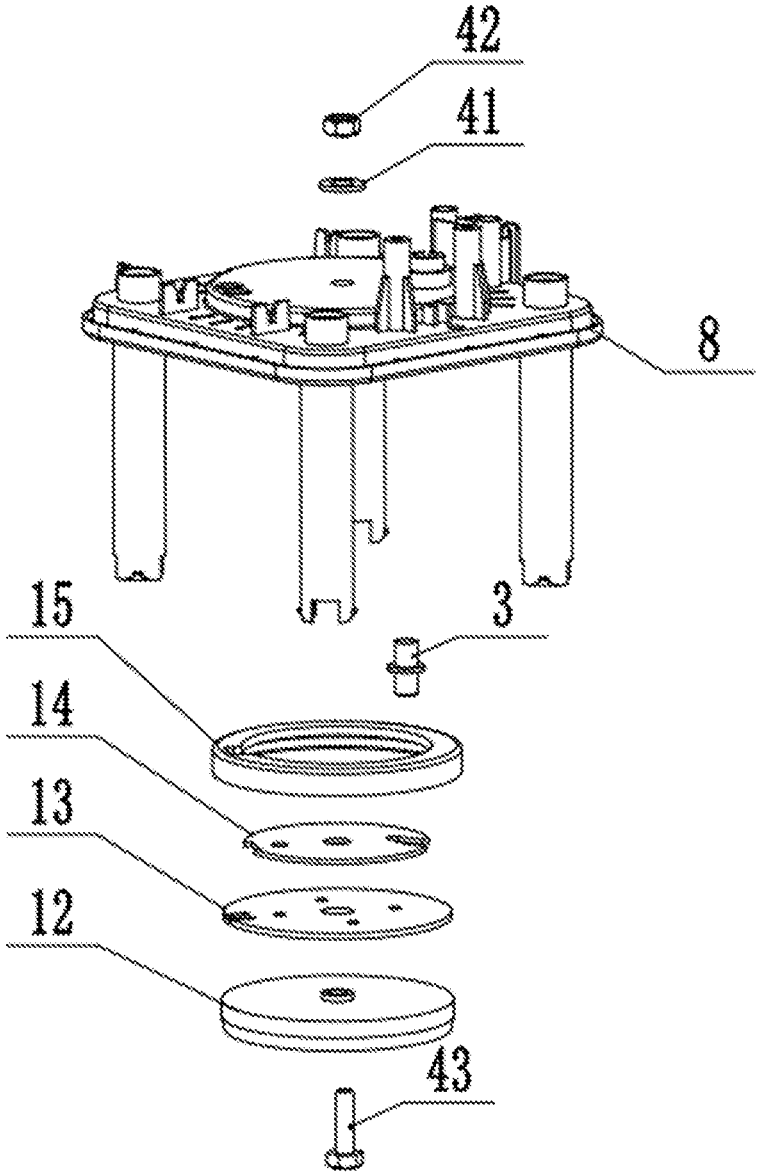
FIG. 5 is a schematic diagram of mounting a heating unit according to Embodiment 2 of the disclosure.
Figure 6:
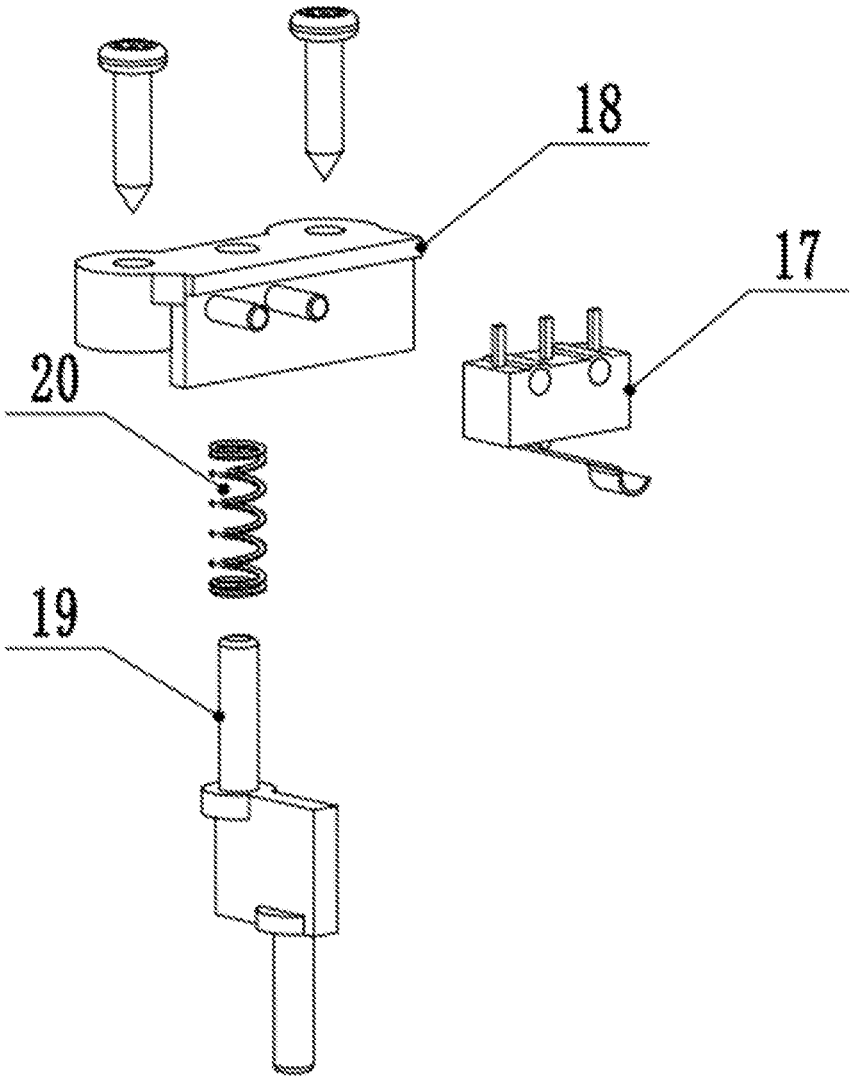
FIG. 6 is a schematic structural diagram of a position switch according to Embodiment 2 of the disclosure.
Figure 7:
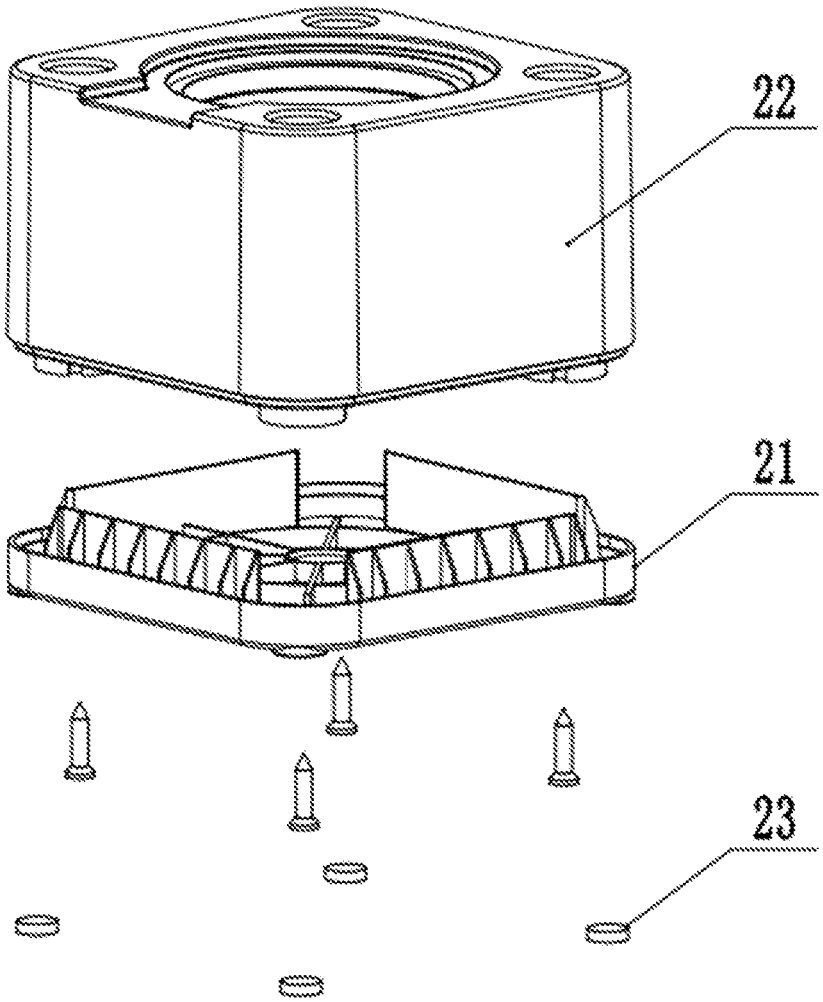
FIG. 7 is a schematic diagram of a lower portion structure according to Embodiment 2 of the disclosure.
Figure 8:
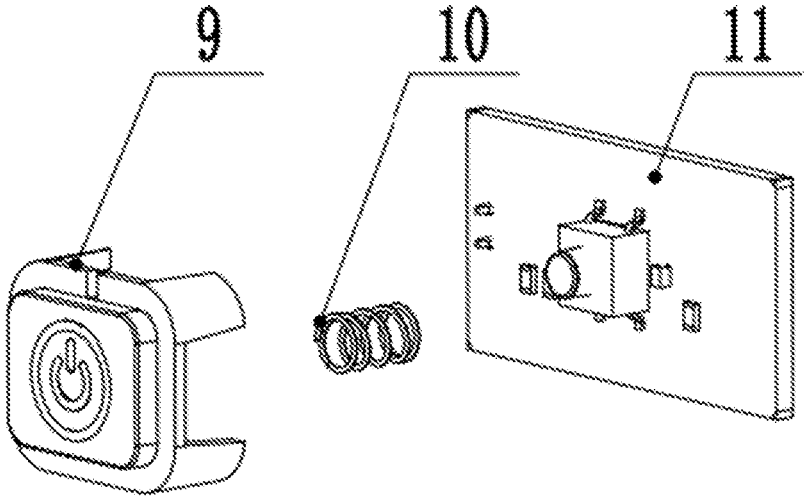
FIG. 8 is a schematic diagram of a preheating switch according to Embodiment 2 of the disclosure.
Figure 9:
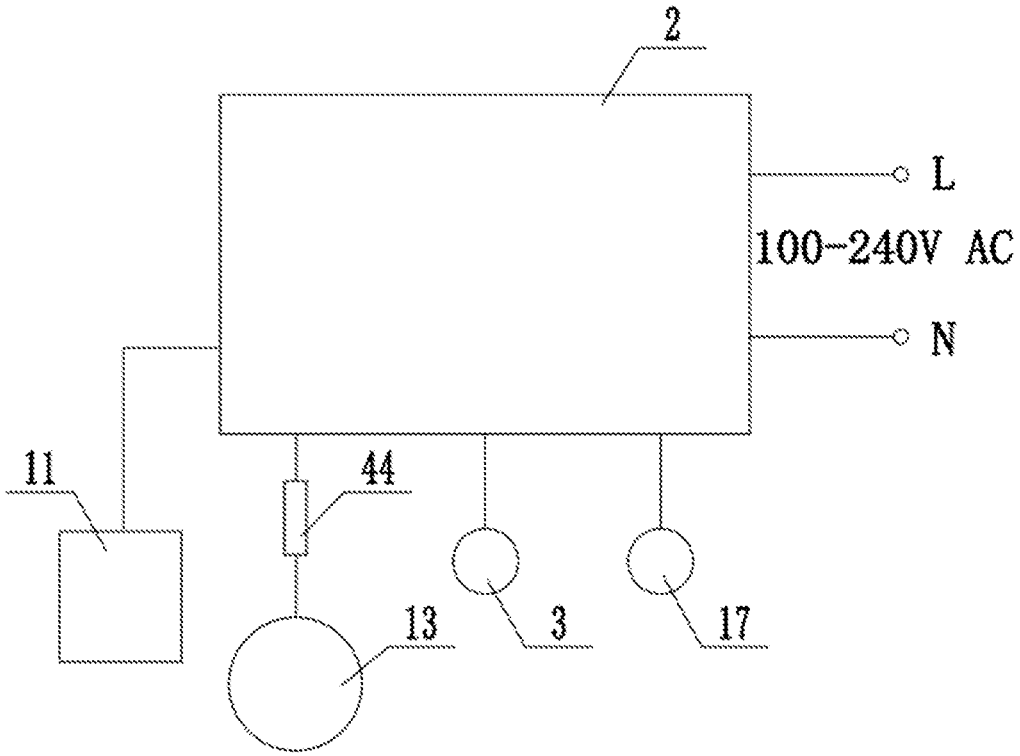
FIG. 9 is a schematic circuit diagram of the machine for manufacturing a coffee capsule according to Embodiment 2 of the disclosure.

The following describes multiple exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure without creative efforts shall fall within the protection scope of the disclosure.

Embodiment 1

According to an implementation of the embodiment, the disclosure provides a machine for manufacturing a coffee capsule, including an upper portion structure, a capsule holder 1, and a lower portion structure sequentially arranged from top to bottom. The upper surface of the upper portion structure includes a recess for accommodating the capsule holder 1. The capsule holder 1 is used for bearing a coffee capsule. The upper portion structure includes a box body, a control unit 2, a heating unit, a preheating switch, a temperature probe 3, a power line 4, and a position sensing structure. The heating unit, the preheating switch, the temperature probe 3, the power line 4, and the position sensing structure are respectively electrically connected with the control unit 2. The temperature probe 3 is used for sensing the temperature of the heating unit, the control unit 2 is arranged in the box body, the preheating switch is arranged at the outer side of the box body, the heating unit is arranged at the lower side of the box body and is in separable contact with a coffee capsule in the capsule holder 1. The position sensing structure may sense and identify contact and separation of the heating unit and the coffee capsule and transmits a signal to the control unit 2. The power line 4 is used for connecting to an external power supply. In order to improve the safety, the control unit 2 of the embodiment is in series connection with a thermal protector.

In use, firstly the preheating switch is pressed down after the power line 4 is connected to the external power supply. The control unit 2 obtains a preheating signal and then powers on the heating unit such that the heating unit heats. During heating, the temperature of the heating unit is sensed by the temperature probe 3, and a temperature signal is transmitted to the control unit 2 in real time. After the temperature of the heating unit reaches a preset preheating temperature of the control unit 2, the control unit 2 powers off the heating unit such that the heating unit stops heating. At the same time, the coffee capsule may be placed in the recess of the capsule holder 1. The coffee capsule has a main body and a sealing membrane, the heating unit moves downwards to be in contact with the sealing membrane, the position sensing structure obtains a contact signal and transmits the contact signal to the control unit 2 when the heating unit and the sealing membrane are in contact, the control unit 2 controls the heating unit to continuously heat, the heating unit is separated from the coffee capsule after the heating continues for a while (the specific time may be defined by the preheating temperature), and then a hot pressed coffee capsule may be taken out. At the same time, the position sensing structure obtains a separating signal and transmits the separating signal to the control unit 2, and the control unit 2 powers off the heating unit to stops heating.

A preheating complete signal and a hot pressing complete signal are sent by a buzzer, an indicator lamp or a display screen, and as long as the buzzer, the indicator lamp or the display screen is electrically connected to the control unit 2, the control unit 2 may send a corresponding signal after the heating unit reaches the preheating temperature or the hot pressing time for a relative preset time. Optionally, the temperature probe 3 is an NTC probe, and a heating sheet 13 is an MCH heating sheet 13.

There are multiple manners for achieving movement of the heating unit and a plurality of manners capable of detecting the position of the heating unit. Following Embodiment 2 and Embodiment 3 merely disclose some non-limiting examples.

Embodiment 2

Figure 10:
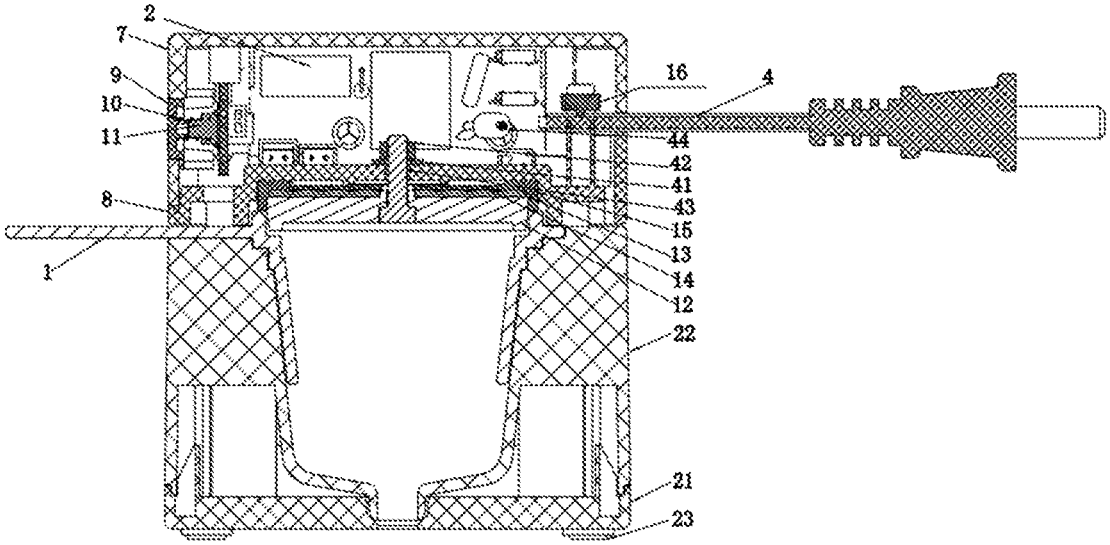
FIG. 10 is a sectional view of the machine for manufacturing a coffee capsule in the hot pressing state according to Embodiment 2 of the disclosure.

As shown in FIG. 1. to FIG. 10, the embodiment provides a machine for manufacturing a coffee capsule, which has all technical characteristics of Embodiment 1 except that the heating unit is driven manually in this embodiment, and the position switch is used to detect a position relation between the heating unit and the coffee capsule.

According to an implementation of the embodiment, the box body includes a plurality of vertical guide bars 5, the lower portion structure includes guide holes matching with the guide bars 5, a guide spring 6 sleeves the outer side of the guide bar 5, or the guide spring 6 is filled in an axial through hole of the guide bar 5, the upper end of the guide spring 6 abuts against the box body, the lower end of the guide spring 6 abuts against the lower portion structure, and the position sensing structure is a position switch. After the coffee capsule is placed in the recess of the capsule holder 1, the box body is pressed down, and the box body slides downwards along the guide bars 5 till the heating unit abuts against the coffee capsule. Due to a guiding function of the guide bars 5, the heating unit may be aligned to the coffee capsule to avoid situations that the heating is uneven and the seal is not tight. The box body is loosened after the hot pressing is completed, and the box body moves upwards under the elasticity function of the guide springs 6 so as to be mutually separated from the lower portion structure.

The box body is mainly used for accommodating and protecting internal electronic elements. In the embodiment, the box body includes a top cover 7 and a base 8, which are detachably fixedly connected. The heating unit is fastened on the base 8 by fasteners. The preheating switch includes a preheating button 9, a spring 10 and a first PCB switch board 11. The preheating switch 9 is arranged at the top cover 7, the top cover 7 includes an opening corresponding to the preheating button 9, the first PCB switch board 11 is arranged in the top cover 7, a reset spring 10 is arranged between the first PCB switch board 11 and the preheating switch in order to elastically connect them, and the first PCB switch board 11 is fixed and electrically connected to a PCB main board of the control unit 2. When the preheating button 9 is pressed down, the preheating button 9 abuts against the first PCB switch board 11 such that a circuit of the first PCB switch board 11 is transiently connected, the control unit 2 obtains a preheating signal to power on the heating unit, and the heating unit starts heating. After the preheating button 9 is loosened, the preheating button 9 is separated from the first PCB switch board 11 under the action of the reset spring 10, and the circuit of the first PCB switch board 11 is disconnected.

For the hot pressing device, a heating unit has a conventional structure, which may be selected according to requirements by a person skilled in the art. In the embodiment, the heating unit includes a thermal conduction plate 12, a heating sheet 13, a mica plate 14, and a thermal insulation seal ring 15 sequentially arranged from bottom to top. The body of a bolt 43 is in threaded connection with a nut 42 after sequentially passing through the thermal conduction plate 12, the heating sheet 13, the mica plate 14, the thermal insulation seal ring 15, the base 8 and a gasket 41 in order to lock the heating unit to the base 8. In the embodiment, a line clamp 16 is fixed to the base 8 by the fastener after a power line 4 is clamped by the line clamp 16 in order to prevent the power line 4 from loosening.

According to another implementation of the embodiment, the position sensing structure is a position switch and includes a first micro switch 17, a first support 18, a first guide bar 19 and a first spring 20, the first support 18 is fixed to the upper side of the base 8 through the fasteners, and the first micro switch 17 is electrically connected to the control unit 2. The first guide bar 19 has a Z-shaped structure, the lower end of the first guide bar 19 passes through the base 8 while the upper end of the first guide bar 19 passes through the first support 18, the first guide bar 19 may slide corresponding to the base 8 and the first support 18, and the first spring 20 is located between the first guide bar 19 and the first support 18. When the heating unit is in contact with the coffee capsule, a portion, extending from the base 8, of the lower end of the first guide bar 19 retracts the base 8 under an upward pressure, the first guide bar 19 slides upwards, its upper end triggers the first micro switch 17, and the control unit 2 powers on the heating unit such that the heating unit heats. When the heating unit is separated from the coffee capsule, the upper end of the first guide bar 19 is separated from the first micro switch 17 under the elasticity function of the first spring 20, the circuit of the first micro switch 17 is disconnected, and the control unit 2 obtains the separating signal and then stops power supply of the heating unit.

In order to save materials, the lower portion structure of the embodiment is a hollow structure and includes a capsule holder bottom cover 21 and a capsule holder top cover 22, the capsule holder bottom cover 21 and the capsule holder top cover 22 are separably fixedly connected through the fasteners, and anti-skid pads 23 are arranged on the lower surface of the capsule holder bottom cover 21 in order to improve the anti-skid property.

Embodiment 3

Figure 11:
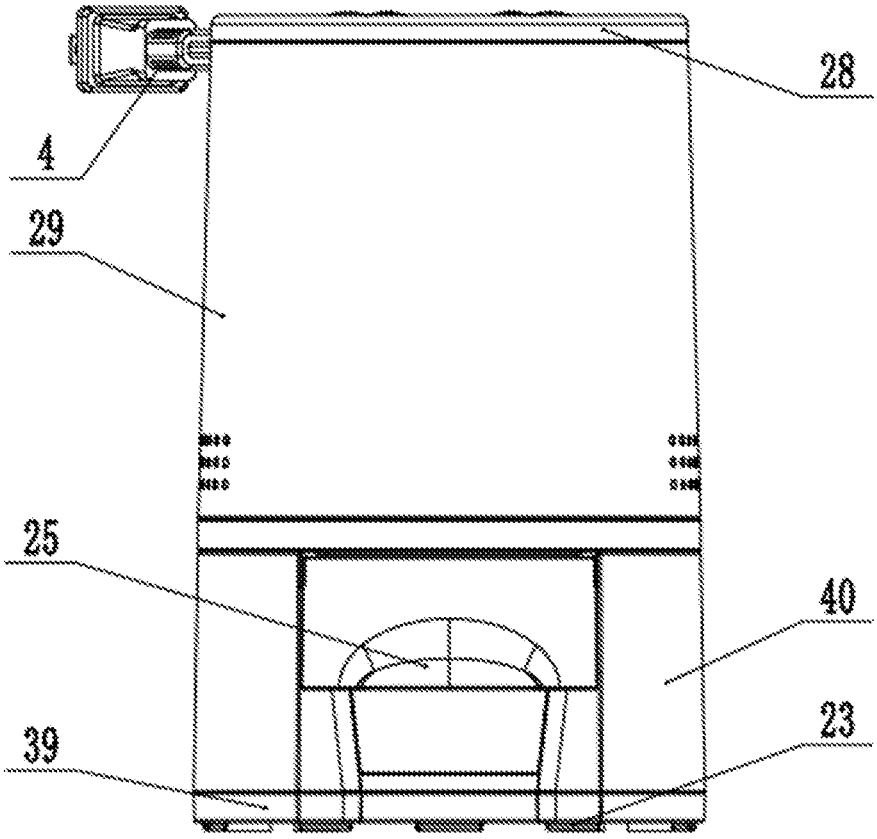
FIG. 11 is a front view of a machine for manufacturing a coffee capsule in the hot pressing state according to Embodiment 3 of the disclosure.
Figure 12:
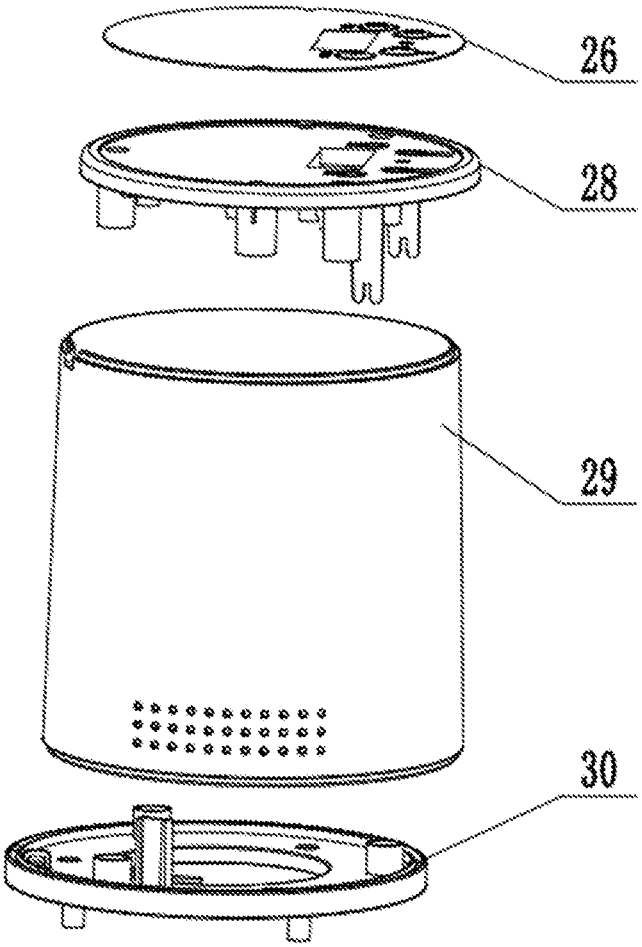
FIG. 12 is a schematic structural diagram of a box body according to Embodiment 3 of the disclosure.
Figure 13:
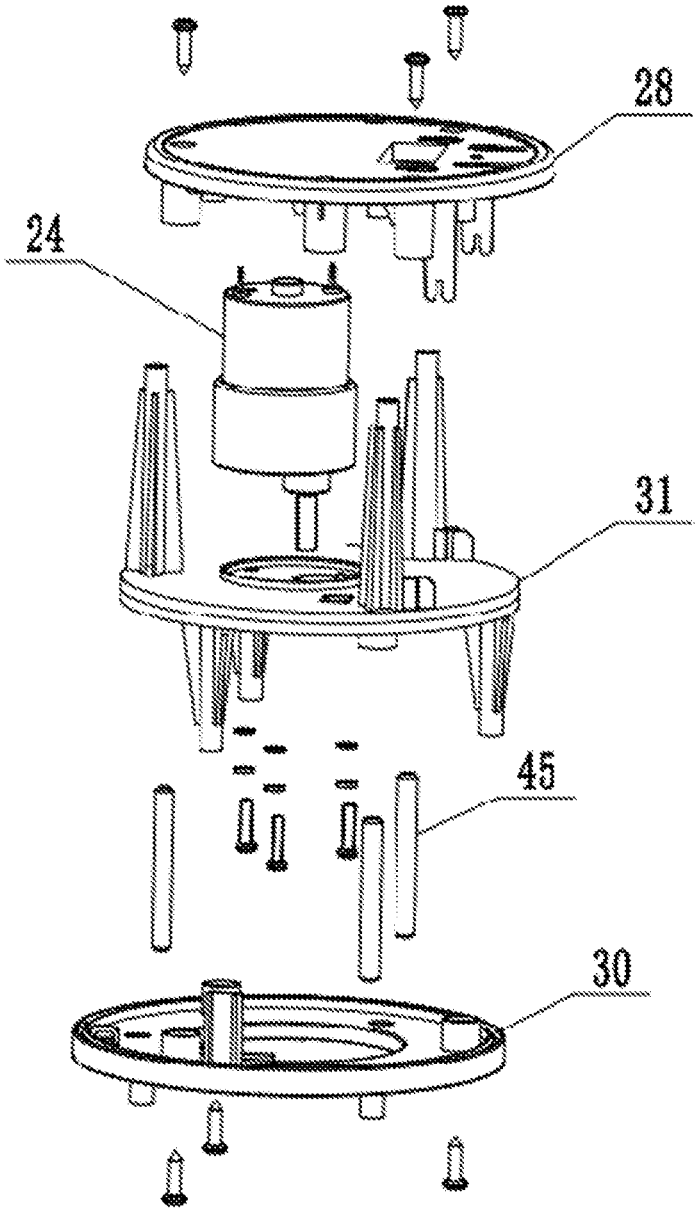
FIG. 13 is a schematic diagram of mounting a motor bracket according to Embodiment 3 of the disclosure.
Figure 14:
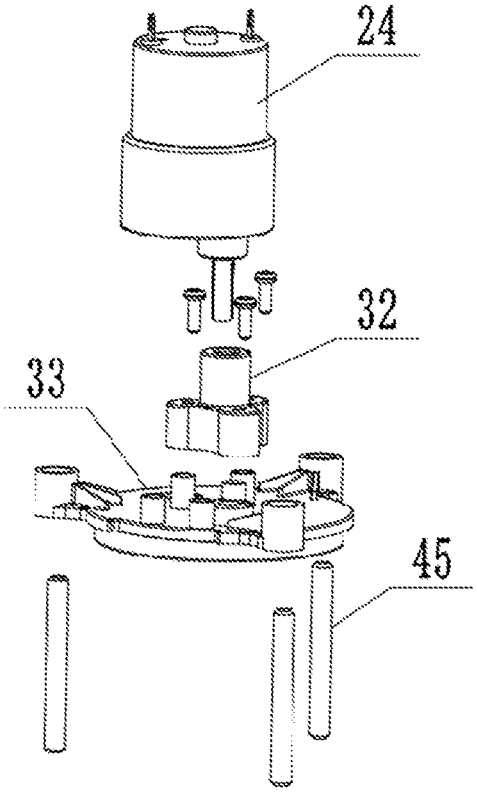
FIG. 14 is a schematic diagram of mounting a sliding block structure according to Embodiment 3 of the disclosure.
Figure 15:
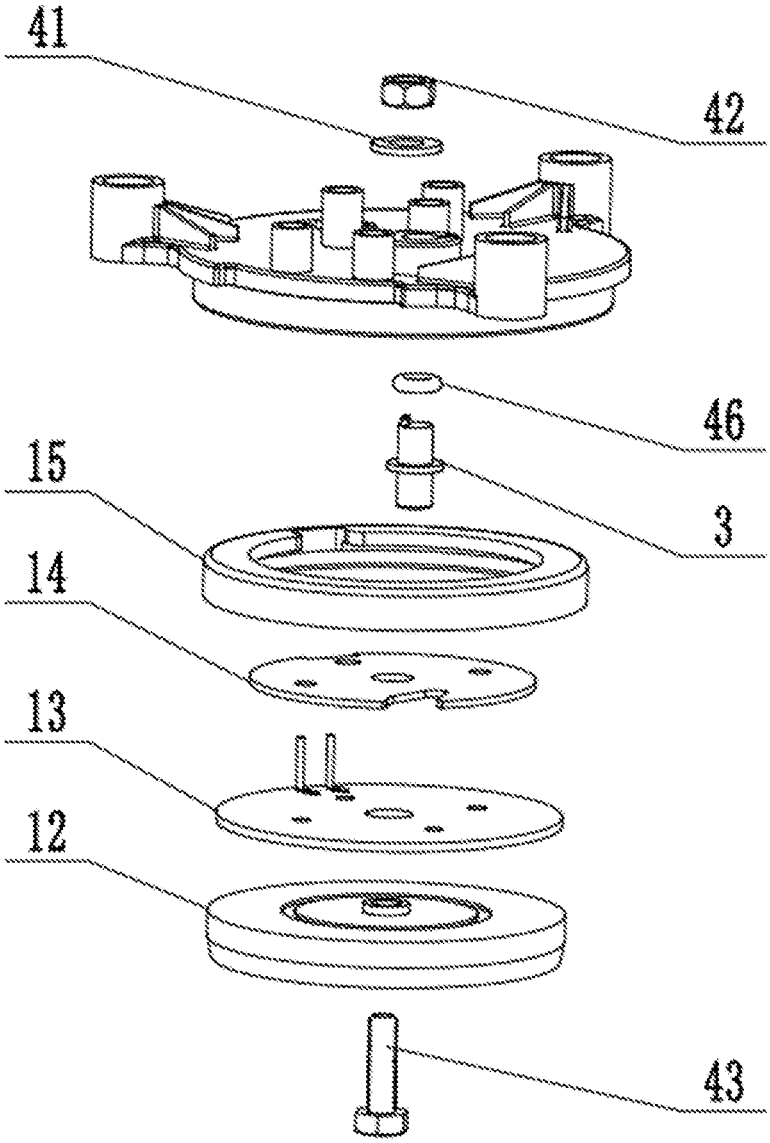
FIG. 15 is a schematic diagram of mounting a heating unit according to Embodiment 3 of the disclosure.
Figure 16:
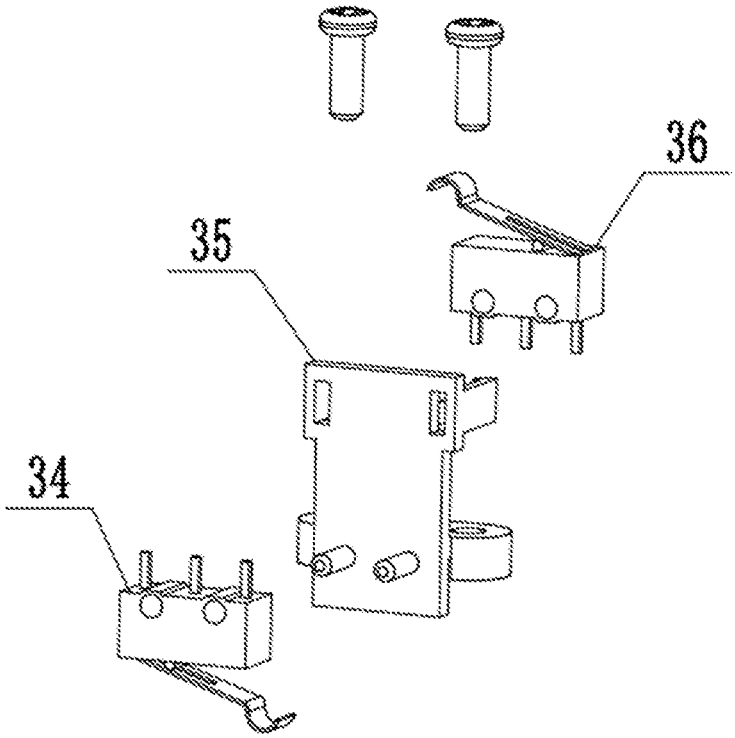
FIG. 16 is a schematic diagram of mounting a position sensing structure according to Embodiment 3 of the disclosure.
Figure 17:
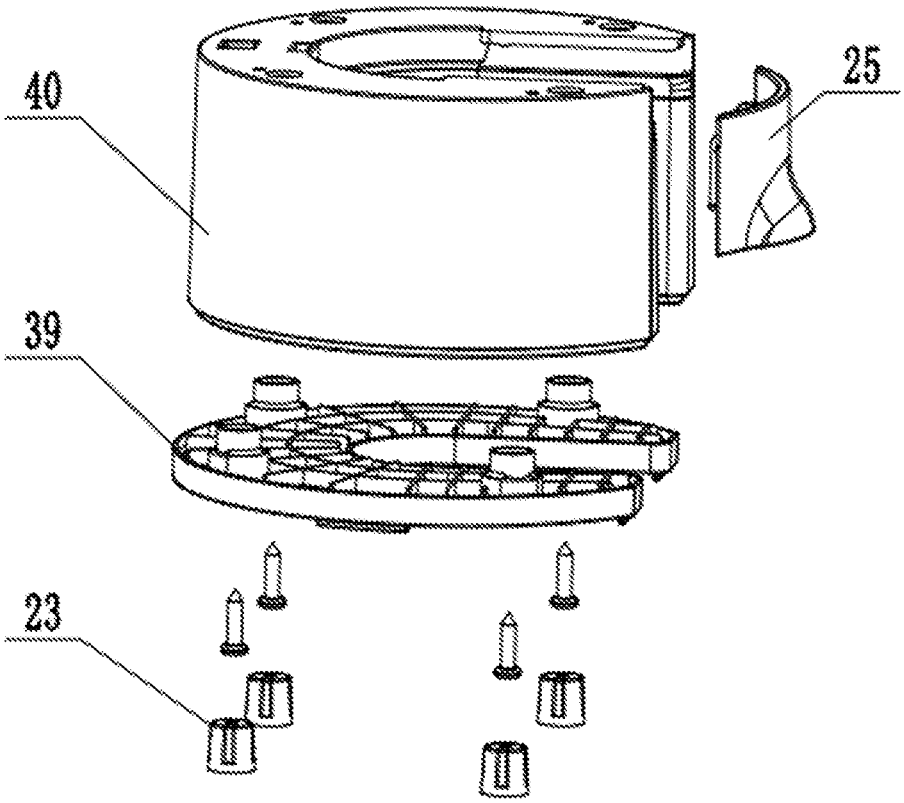
FIG. 17 is a schematic diagram of a lower portion structure according to Embodiment 3 of the disclosure.
Figure 18:
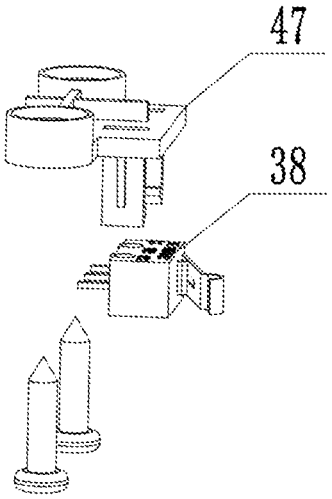
FIG. 18 is a schematic diagram of mounting a fourth micro switch according to Embodiment 3 of the disclosure.
Figure 19:
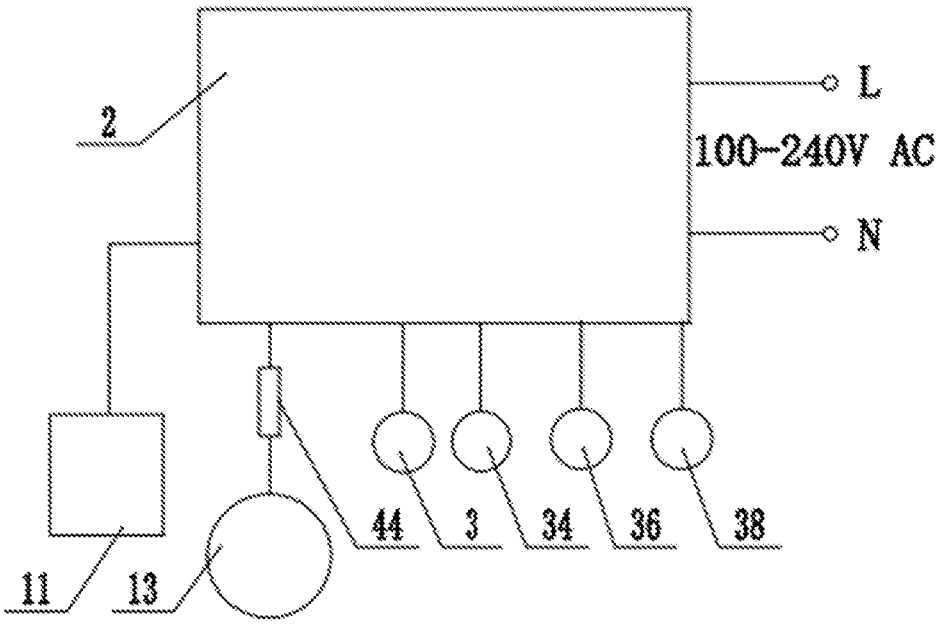
FIG. 19 is a schematic circuit diagram of the machine for manufacturing a coffee capsule according to Embodiment 3 of the disclosure.
Figure 20:
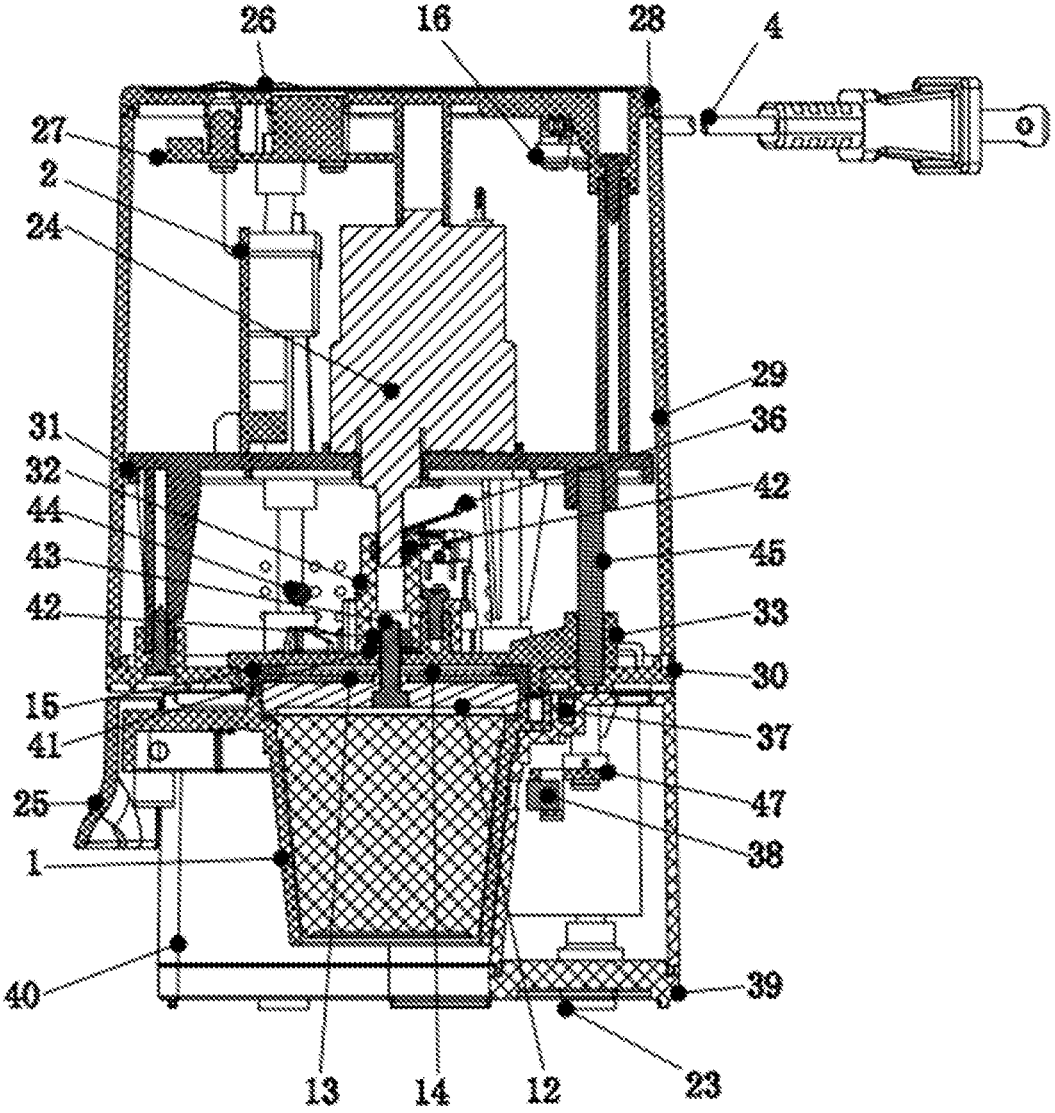
FIG. 20 is a sectional view of the machine for manufacturing a coffee capsule in the hot pressing state according to Embodiment 3 of the disclosure.

As shown in FIG. 11. to FIG. 20, the embodiment provides a machine for manufacturing a coffee capsule, which has all technical characteristics of Embodiment 1 except that up-and-down movement of the heating unit in the embodiment is automatically controlled.

According to an implementation of the embodiment, a motor 24 and a sliding block structure located on the lower side of the motor 24 are further arranged. The motor 24 is fixed in the box body and is electrically connected to the control unit 2, a control button is arranged on the outer side of the box body, the control button is electrically connected to the control unit 2, and the control button may control forward and reverse rotation of the motor 24. An output shaft of the motor 24 is inserted into the sliding block structure downwards and is in threaded connection with the sliding block structure, and the sliding block structure is connected to an axial hole of the box body such that the sliding block structure moves up and down and does not rotate when the output shaft of the motor 24 rotates. The heating unit is fixed to the sliding block structure and is in contact with or separated from the coffee capsule along with the movement of a sliding block. A gap is formed in a side face of the lower portion structure, the capsule holder 1 may be put in and taken out through the gap, and a holder cover 25 is detachably fixed to the gap. Because the box body is fixedly connected with the lower portion structure, the capsule holder 1 is put in and taken out from a side face to be capable of avoiding frequent detachment of a combination structure of the box body and the lower portion structure, which is simple and convenient.

According to another implementation of the embodiment, the box body includes an overlay surface 26, a second PCB switch board 27, an upper cover 28, a housing 29, and a lower support 30 sequentially arranged from top to bottom. A motor bracket 31 is arranged in the box body. A display screen and a second PCB switch board 27 are fixed to the upper cover 28, and the overlay surface 26 is adhered on the upper surface of the upper cover 28 and covers the display screen and the second PCB switch board 27. A through hole for accommodating the second PCB switch board 27 is formed in the upper cover 28, and the second PCB switch board 27 is electrically connected to the control unit 2. The overlay surface 26 is used for protecting the second PCB switch board 27, the second PCB switch board 27 is taken as a control button, and the forward rotation and the reverse rotation of the motor 24 may be controlled by the second PCB switch board 27. The upper cover 28 is fixed to an opening of the upper portion of the housing 29, and the motor 24 is fixed to the motor bracket 31 through the fasteners. The sliding block structure includes a nut block 32 and a heating unit bracket 33, the nut block 32 is in threaded connection with the output shaft of the motor 24, and the nut block 32 is detachably fixed to the heating unit bracket 33. Through holes allowing penetration of guide shafts 45 are formed in the heating unit bracket 33, the upper end and the lower end of the guide shaft 45 are respectively inserted into limiting blind holes of the motor bracket 31 and the lower support 30, integrally formed upper extension rods and lower extension rods are respectively arranged at the upper side and the lower side of the motor bracket 31, the upper extension rod locks the upper cover 28 through the fastener, and the lower extension rod locks the lower support 30 through the fasteners so that the housing 29 is clamped between the upper cover 28 and the lower support 30. Annular slots for accommodating edges of the housing 29 are formed in the lower surface of the upper cover 28 and the upper surface of the lower bracket 30.

In the field of hot pressing devices, the heating unit has a conventional structure, which may be selected according to requirements by a person skilled in the art. In the embodiment, the heating unit includes a thermal conduction plate 12, a heating sheet 13, a mica plate 14, and a thermal insulation seal ring 15 sequentially arranged from bottom to top. The body of a bolt 43 is in threaded connection with a nut 42 after sequentially passing through the thermal conduction plate 12, the heating sheet 13, the mica plate 14, the thermal insulation seal ring 15, the heating unit bracket 33 and a gasket 41 in order to lock the heating unit to the heating unit bracket 33. The middle portion of the lower support 30 has a through structure in which the heating unit may move up and down. The temperature probe 3 is located between the heating sheet 13 and the heating unit bracket 33, the lower end of the temperature probe 3 is in contact with the heating sheet 13, and a damper ring 46 is arranged between the upper end of the temperature probe 3 and the heating unit bracket 33. The heating sheet 13 is in series connection with a fuse 44, and the fuse 44 is a thermal cutoff According to a further implementation of the embodiment, the position sensing structure is fixed to the heating unit bracket 33 and includes a second micro switch 34 and a third micro switch 36, The second micro switch 34 and the third micro switch 36 are electrically connected to the control unit 2. The structure of the second micro switch 34 is used for sensing a relative position of the heating unit bracket 33 and the lower support 30. The structure of the third micro switch 36 is used for sensing a relative position of the heating unit bracket 33 and the motor bracket 31. The second micro switch 34 is fixed to the lower portion of the second support 35, the third micro switch 36 is fixed to the upper portion of the second support 35, and the second support 35 is fixed to the heating unit bracket 33 through the fasteners. When the heating unit is in contact with the coffee capsule, the second micro switch 34 is switched on, and when the heating unit is separated from the coffee capsule, the second micro switch 34 is switched off. When the heating unit bracket 33 moves upwards to an original position, the third micro switch 36 is switched on, and when the heating unit bracket 33 moves downwards from an initial position of the upper portion, the third micro switch 36 is switched off. When the second micro switch 34 is switched from an off state to an on state, the control unit 2 controls the motor 24 to stop rotating and the heating unit to conduct secondary heating after the preheating. When the second micro switch 34 is switched from the on state to the off state, the heating unit stops heating. When the third micro switch 36 is switched from the off state to the on state, the motor 24 stops rotating.

The above position sensing structure may also be a blocked-rotor detection unit, the blocked-rotor detection unit is used for detecting whether the motor 24 conducts rotor blockage, and the blocked-rotor detection unit is electrically connected to the control unit 2. The blocked-rotor detection unit for detecting whether the motor 24 conducts rotor blockage has a conventional structure in the art, which is not described herein.

When the capsule holder 1 is located in the lower portion structure, a magnet 37 is fixed to the capsule holder 1 while another magnet 37 is fixed to an inner side face of the gap of the lower portion structure in order to prevent transverse shaking of the capsule holder 1, so the capsule holder 1 and the lower portion structure are tightly contacted due to adsorption.

In order to further improve the safety, in some embodiments, a third support 47 is fixed to the gap of the lower portion structure by fasteners, a fourth micro switch 38 is fixed to the third support 47, and the fourth micro switch 38 is electrically connected to the control unit 2. When the capsule holder 1 is fixed to an appointed position in the lower portion structure, the fourth micro switch 38 is switched on, and when the capsule holder 1 is deviated from the appointed position or the capsule holder 1 is not placed in the lower portion structure, the fourth micro switch 38 is switched off. After the preheating is completed, a control command sent by the control button to drive the motor 24 to rotate may be valid only when the fourth micro switch 38 is switched on.

In order to save materials, the lower portion structure of the embodiment is a hollow structure and includes a capsule holder bottom cover 39 and a capsule holder base 40, the capsule holder bottom cover 39 and the capsule holder base 40 are fixedly connected through the fasteners, and the anti-skid pads 23 are arranged on the lower surface of the capsule holder bottom cover 39 in order to improve the anti-skid property.

Several examples are used for illustration of the principles and implementation methods of the specification. The description of the embodiments is used to help illustrate the method and its core principles of the disclosure. In addition, those skilled in the art may make various modifications in terms of specific embodiments and scope of application in accordance with the teachings of the disclosure. In conclusion, the content of this specification shall not be construed as a limitation to the invention.

Various embodiments of the disclosure may have one or more of the following effects. A machine for manufacturing a coffee capsule as disclosed may be convenient to use, may have a relatively simple structure, and may have a good sealing effect. The machine may turn a great coffee enjoyment to be easier, more affordable, and more convenient.

Customers may only need to pay a tiny fee for capsule cups and sealing membranes, and then conveniently turn coffee powders into coffee capsules by themselves.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The invention claimed is:

1. A machine for manufacturing a coffee capsule, comprising an upper portion structure, a capsule holder, and a lower portion structure sequentially arranged from top to bottom; wherein:

an upper surface of the upper portion structure further comprises a recess for accommodating the capsule holder which is used for bearing a coffee capsule;

the upper portion structure further comprises a box body, a control unit, a heating unit, a preheating switch, a temperature probe, a power line, and a position sensing structure;

the heating unit, the preheating switch, the temperature probe, the power line, and the position sensing structure are respectively electrically connected with the control unit;

the temperature probe is used for sensing a temperature of the heating unit;

the control unit is arranged in the box body;

the preheating switch is arranged at an outer side of the box body;

the heating unit is arranged at a lower side of the box body and is in separable contact with the coffee capsule in the capsule holder;

the position sensing structure senses and identifies contact and separation of the heating unit and the coffee capsule, and transmits a signal to the control unit; and the power line is used for connecting to an external power supply.

2. The machine according to claim 1, wherein:

the box body comprises a plurality of guide bars;

the lower portion structure comprises guide holes matching with the guide bars;

a guide spring sleeves the outer side of the guide bar or is filled in the guide bar;

an upper end of the guide spring abuts against the box body;

a lower end of the guide spring abuts against the lower portion structure;

the position sensing structure is a position switch; and the position switch is electrically connected to the control unit.

3. The machine according to claim 2, wherein the heating unit comprises a thermal conduction plate, a heating sheet, a mica plate, and a thermal insulation seal ring sequentially arranged from bottom to top.

4. The machine according to claim 2, wherein the box body comprises a top cover and a base detachably fixedly connected.

5. The machine according to claim 4, wherein the heating unit is locked on the base by fasteners.

6. The machine according to claim 1, further comprising a motor and a sliding block structure located on the lower side of the motor, wherein:

the motor is fixed in the box body and is electrically connected to the control unit;

a control button is arranged on the outer side of the box body and controls operation of the motor;

an output shaft of the motor is inserted into the sliding block structure downwards and is in threaded connection with the sliding block structure;

the sliding block structure is connected to an axial hole of the box body such that the sliding block structure does not rotate when moving up and down;

the heating unit is fixed to the sliding block structure;

a gap is formed in a side face of the lower portion structure;

the capsule holder is put in and taken out through the gap; and a holder cover is detachably fixed to the gap.

7. The machine according to claim 6, wherein:

the box body comprises an overlay surface, a second PCB switch board, an upper cover, a housing, and a lower support sequentially arranged from top to bottom;

a motor bracket is arranged in the box body;

the overlay surface is adhered on the upper surface of the upper cover;

the second PCB switch board is fixed to the upper cover;

a through hole for accommodating the second PCB switch board is formed in the upper cover;

the second PCB switch board is electrically connected to the control unit;

the upper cover is fixed to an opening of the upper portion of the housing;

the motor is fixed to the motor bracket;

the sliding block structure comprises a nut block and a heating unit bracket;

the nut block is in threaded connection with the output shaft of the motor;

the nut block is detachably fixed to the heating unit bracket;

through holes allowing penetration of guide shafts are formed in the heating unit bracket;

an upper end and a lower end of the guide shaft are respectively inserted into limiting blind holes of the motor bracket and the lower support; and the motor bracket and the housing are respectively detachably and fixedly connected to the lower support.

8. The machine according to claim 7, wherein:

the position sensing structure is fixed to the heating unit bracket and comprises a second micro switch and a third micro switch;

the second micro switch is used for sensing a relative position of the heating unit bracket and the lower support;

the third micro switch is used for sensing a relative position of the heating unit bracket and the motor bracket; and the second micro switch and the third micro switch are electrically connected with the control unit.

9. The machine according to claim 6, wherein the heating unit is locked on a heating unit bracket by fasteners.

10. The machine according to claim 6, wherein:

the position sensing structure is a blocked-rotor detection unit;

the blocked-rotor detection unit is used for detecting whether the motor conducts rotor blockage; and the blocked-rotor detection unit is electrically connected to the control unit.

11. The machine according to claim 6, wherein the heating unit comprises a thermal conduction plate, a heating sheet, a mica plate and a thermal insulation seal ring sequentially arranged from bottom to top.

* * * * *